US008298304B1

(12) United States Patent
Moore

(10) Patent No.: US 8,298,304 B1
(45) Date of Patent: Oct. 30, 2012

(54) COAL TREATMENT PROCESS FOR A COAL-FIRED POWER PLANT

(75) Inventor: Keith A. Moore, Oxnard, CA (US)

(73) Assignee: Castle Light Corporation, Westlake Village, CA (US)

( * ) Notice: Subject to any disclaimer, the term of this patent is extended or adjusted under 35 U.S.C. 154(b) by 722 days.

(21) Appl. No.: 12/378,950

(22) Filed: Feb. 20, 2009

(51) Int. Cl.
*C10L 9/00* (2006.01)

(52) U.S. Cl. ..... 44/627; 44/621; 44/505

(58) Field of Classification Search ..... 44/627, 44/505, 621
See application file for complete search history.

(56) References Cited

U.S. PATENT DOCUMENTS

| | | | | |
|---|---|---|---|---|
| 3,449,213 | A | 6/1969 | Knapp et al. | |
| 3,560,347 | A | 2/1971 | Knapp et al. | |
| 4,118,282 | A | 10/1978 | Wallace | |
| 4,123,230 | A | 10/1978 | Kirkbride | |
| 4,148,614 | A | 4/1979 | Kirkbride | |
| 4,234,402 | A | 11/1980 | Kirkbride | |
| 4,259,560 | A | 3/1981 | Rhodes | |
| 4,419,214 | A * | 12/1983 | Balint et al. | 208/402 |
| 5,755,333 | A * | 5/1998 | Stencel et al. | 209/127.1 |
| 2005/0089460 | A1 * | 4/2005 | Tranquilla | 423/107 |
| 2005/0188608 | A1 * | 9/2005 | Dunlop et al. | 44/620 |
| 2007/0131591 | A1 | 6/2007 | Pringle | |
| 2007/0158174 | A1 * | 7/2007 | Livneh et al. | 204/157.43 |
| 2009/0120379 | A1 * | 5/2009 | Bozzuto et al. | 122/5 |

FOREIGN PATENT DOCUMENTS

WO WO/2007/028208 3/2007

* cited by examiner

*Primary Examiner* — Jim Goloboy
(74) *Attorney, Agent, or Firm* — Thomas I. Rozsa

(57) ABSTRACT

A coal treatment process containing a coal-beneficiation process module. The module is implemented into the conventional coal treatment process of a coal-fired power plant after a first step of grinding the coal in a coal mill. The process module sequentially extracts chemical substances of non-combustible ash, water, mercury and oil that are found in coal before the coal is fired, so that present invention can produce valuable products and achieve a high quality cleaned powdered coal-char to burn in a furnace to thereby reduce pollution and increase the efficiency of energy production from the coal.

13 Claims, 5 Drawing Sheets

COAL TREATMENT PROCESS FOR A COAL-FIRED POWER PLANT

BACKGROUND OF THE INVENTION

1. Field of the Invention

The present invention is related to a coal treatment process for a coal fired power plant, and particularly for a process, which is implemented with a coal-beneficiation process module to extract water, non-combustible ash, mercury and oil that are associated with coal before firing the coal.

2. Description of the Prior Art

Technologies for the treatment of coal to improve its quality as a fuel for power plants have been known including pyrolysis of coal with microwave energies. The following nine patents and published patent applications are the closest prior art references which are related to the present invention.

1. U.S. Pat. No. 3,449,213 issued to Edward M. Knapp et. al on Jun. 10, 1969 for "Pyrolysis of Coal With Microwave" (hereafter the "Knapp '213 Patent");
2. U.S. Pat. No. 3,560,347 issued to Edward M. Knapp et. al on Feb. 2, 1971 for "Apparatus For Carbonizing Carbonaceous Materials Using Microwave Energy" (hereafter the "Knapp '347 Patent");
3. U.S. Pat. No. 4,118,282 issued to Floyd D. Wallace and assigned to Wallace Energy Conversion, Inc. on Oct. 3, 1978 for "Process And Apparatus For The Destructive Distillation Of High Molecular Weight Organic Materials" (hereafter the "Wallace Patent");
4. U.S. Pat. No. 4,123,230 issued to Chalmer G. Kirkbride on Oct. 31, 1978 for "Sulfur Removal From Coal" (hereafter the "Kirkbride '230 Patent");
5. U.S. Pat. No. 4,148,614 issued to Chalmer G. Kirkbride on Apr. 10, 1979 for "Process For Removing Sulfur From Coal" (hereafter the "Kirkbride '614 Patent");
6. U.S. Pat. No. 4,234,402 issued to Chalmer G. Kirkbride on Nov. 18, 1980 for "Sulfur Removal From Crude Petroleum" (hereafter the "Kirkbride '402 Patent");
7. United States Patent Published Application No. US2007/0131591 to Frank G. Pringle and published on Jun. 14, 2007 for "Microwave-Based Recovery of Hydrocarbons and Fossil Fuels" (hereafter the "Pringle Patent Application");
8. U.S. Pat. No. 4,259,560 issued to George W. Rhodes on Mar. 31, 1981 for "Process for Drying Coal and Other Conductive Materials Using Microwaves" (hereafter the "Rhodes Patent"); and
9. Australia Patent Published Application No WO/2007/028208 to Edek Choros and published on Mar. 15, 2007 for "Hybrid Energy System" (hereinafter the Choros patent application)

The Knapp '213 Patent discloses a method for recovering sophisticated volatile materials of commerce extracted by heat from coal. The method consists of the following four steps: (1) The heating of coal to a temperature of approximately 600 F; (2) The pyrolysis of the coal by the use of an industrial heating microwave unit to a temperature of approximately 800 F in a partial vacuum; (3) The total absorption of the effluent from the pyrolysis in an oil bath, followed by partial desorption of the chemicals of commerce at a temperature which separates the chemicals of commerce and (4) The vapor phase fractionation of the resulting gas stream prior to any commingling of the chemicals of commerce and before returning to ambient temperature.

The Knapp '347 Patent, which is a division of the Knapp '213 Patent, discloses an apparatus for carbonizing coal. The coal is first preheated in a first chamber by direct contact with hot gases, and is then carbonized in a second chamber using microwave energy as the heat source. The volatile materials from the second chamber are fractionally condensed.

The Wallace Patent discloses a process and apparatus for destructive distillation of high molecular weight organic materials such as organic wastes using ultrasonic and microwave generators together to irradiate and molecularly disperse the organic'molecules in the organic materials. Application of the patented technology produces products of clean gaseous volatile chemicals having a high fuel value and by-products of charcoal, tars, resins and pure carbon.

The Kirkbride '230 Patent discloses a process for decreasing the sulfur content of coal, including drying coal and subjecting the dried coal in a hydrogen atmosphere to the influence of microwave energy.

The Kirkbride '614 Patent discloses a process for decreasing the sulfur content of coal, including forming a slurry of coal particles in an inert solvent, and subjecting the slurry in admixture with hydrogen with microwave energy.

The Kirkbride '402 Patent discloses a process for decreasing the sulfur content of coal or crude petroleum, including drying coal and subjecting the dried coal in a hydrogen atmosphere to microwave energy.

The Pringle Patent Application discloses methods for decomposing and extracting compositions for the recovery of petroleum based materials from composites comprising those petroleum-based materials. The methods include subjecting the compositions and/or composites to microwave radiation in the range of from about 4 GHz to about 18 GHz.

The Rhodes Patent discloses a process for drying a conductive material, particularly coal, by subjecting the material to microwave energy, wherein a conductive aggregate is directed, through a region where microwave energy excites absorbed water molecules and the conductive material causes the water evaporate, resulting in a drier material.

The Choros Patent describes a hybrid method for producing energy from a carbonaceous material including the steps of: heating the carbonaceous material under a reduced oxygen atmosphere in a distillation plant to generate distillate vapors; processing the resulting distillate vapors; transferring the char residue from the distillation plant to a power station boiler; and combusting the char residue in the power station boiler for the generation of electrical power.

In general, coal is a primary energy resource to generate electricity at coal-fired power plants in numerous locations throughout the world. Coal is also associated with various other chemical substances, including water, non-combustible ash, mercury and oil. The presence of such chemicals causes significant problems in the coal firing process that is required for producing electricity. The coal's water content lowers the BTU energy value of the coal and reduces the power plant boiler's efficiency. The coal's non-combustible ash content results in boiler furnace erosion and ash-deposition problems. The coal's mercury content causes an air pollution emission, and the coal's oil values are lost during combustion, wasting a valuable natural resource of oil for transportation fuels.

The problems disclosed above have a significant impact on the environment, since a typical 500 mega watts (MW) coal-fired power plant consumes some 7,000 tons of coal a day. In the United States, Wyoming Powder River Basin coal (PRB) is frequently used because it has a low sulfur constituent. Typically, the PRB coal contains 15% to 25% of water, 6% to 15% of non-combustible ash, up to 40% of volatile matter (oil), and mercury constituents (approximately 100-150 parts per Billion). Therefore, if the 500 MW power plant uses the PRB coal every day, the equivalent of 260,000 gallons of water, 700 tons of non-combustible ash and 5,000 barrels of oil are estimated to be consumed, with about 1.4 pounds of mercury released to the atmosphere each day. In a situation where some 281 U.S. power plants fire PRB type coals, the collection and or control of such natural chemical substance in the coal is significant, both in economic impact and environmental protection to the United States. It also will be appreciated that the issue of such substance collection and or control is also critical to rest of the world, where coal fired power plants are frequently used.

A typical coal-fired power plant pulverizes the coal to a fine powder (approximately 50 micron in size) in a coal mill using hot "primary" air extracted from the power plant combustion air heater. As the coal is pulverized, the hot air evaporates the water in the coal and cools. The primary air then conveys the powdered coal along with the water vapor from the coal mill to the power plant coal burners, wherein the coal is burned to create heat and steam for electricity production. The water vapor from the coal that is carried along with the powdered coal into the furnace causes loss of heat energy and results in a boiler efficiency loss. A "rule of thumb" estimates that for each 10% of coal moisture carried into the furnace results in a 1% efficiency loss. Therefore, a method to remove the coal moisture from the furnace will improve the boiler efficiency.

Along with the coal, the non-combustible ash is also pulverized to a fine powder. This ash includes many natural elements and mineral compounds that may form air pollutants and or accumulate as mineral deposits on the boiler furnace surfaces. These deposits reduce the heat transfer from the hot combustion gases to the boiler surfaces, resulting in a reduced boiler efficiency. Additionally, some minerals may cause erosion and or corrosion of the boiler heat transfer surfaces. A reduction of the quantity of the ash passing through the furnace is needed to improve boiler operating reliability and efficiency.

Coal also contains traces of the element mercury. Recent air pollution regulations require stringent control of mercury emissions from power plants. The conventional mercury control methods capture the mercury from the exhaust gases downstream of the power plant where the mercury specie are very dilute (in parts per trillion) and difficult to capture. A method to efficiently remove the mercury from the coal before the coal is fired in the power plant is needed.

Many coals include a volatile hydrocarbon component that may be extracted as a crude oil product. Demonstrated thermal processes to extract oil from coal date from the 1850's, in England and Eastern U.S. driven by the need to avoid the extinction of Whales, a primary source of lamp oil for that period. More recent programs funded by the United States Department of Energy and others have further developed oil from coal extraction processes. The conventional oil extraction methods convey raw lumps of coal (two inch by two inch) to a sealed air-tight vessel. The coal lumps are carefully heated in the absence of air (pyrolyzed) to release some fraction of the volatile matter contained in the coal as an oil vapor. The oil vapor product is then transferred to an oil condenser and collected as a crude oil liquid. The crude oil must be further treated with hydrogen to make it suitable for conventional oil refinery processing into diesel, gasoline and jet fuels. Generally, the process to heat coal lumps is very slow with care to avoid over heating the coal, taking approximately 20 to 60 minutes to vaporize the oil. These time consuming methodologies of coal treatment result in significantly large and costly equipment installations in order process the many tons a day of coal required by a typical coal fired power plant and are not commercially viable.

Therefore, there is an important need to provide a method by which large quantities of coal can be processed very rapidly, right at the power plant site; to collect the water, non-combustible ash, mercury and oil values that are associated with the coal, thereby significantly improving the power plant electric generation efficiency with reduced pollutant emissions, and providing a reduced cost of operation through sale of the oil and water products.

SUMMARY OF THE INVENTION

The present invention is a coal treatment process containing a coal-beneficiation process module. The module is implemented into the conventional coal-fired power plant after the coal treatment process step of grinding the coal with a coal mill to a fine powder. A typical coal-fired power plant may use a multiple of coal mills in order to grind a sufficient quantity of coal to supply the total energy required for the power plant. It is expected that a coal-beneficiation process module will be added to each coal mill, and process the powdered coal from that mill. The process module sequentially extracts chemical substances of water, non-combustible ash, mercury and oil that are naturally present in coal before the coal is burned in the power plant, so that the present invention can achieve goals of increasing the combustion efficiency to produce electricity, reducing pollution in the environment, and saving the precious natural substances at the coal-fired power plants. In addition, the process module treats the fine coal particles conveyed with an inert sweep gas in a fluidity state to thereby achieve the very rapid processing that results in less equipment to treat the coal, and thereby reduce the cost of the process. Another key innovation is that the process is located adjacent to and integrated with the power plant and its coal handling equipment, thereby providing the necessary equipment and inert gases for safe and rapid processing of the large quantities of coal used by the power plant.

The present invention process module includes two preferred embodiments for extracting chemical substances from the powdered coal before the coal is used in a power plant. Both embodiments have the same first steps in the process module to extract the surface water and non-combustible ash from the powdered coal to thereby form a dried powdered coal containing mercury and oil. For the first preferred embodiment, the process comprises extraction of mercury and oil associated with the coal. During the extraction process, the powdered coal is irradiated with microwave energy to quickly heat and vaporize the mercury in the coal, which is released at a lower temperature than the oil. The produced mercury vapor that is separated from the coal is then collected to thereby form a liquid mercury product. In the next step of extracting the oil in the coal, the oil is vaporized by irradiating the powdered coal with additional microwave energies to achieve the necessary higher temperatures to release the oil values. The resulting oil vapor is collected and further condensed to form an oil product.

Alternatively, in the second preferred embodiment, the process uses sufficient microwave energy to simultaneous vaporize both the mercury and oil in the coal. Then the vaporized oil is condensed into a liquid for the oil separation. Then the remaining vaporized mercury is additionally condensed to thereby collect a liquid mercury product.

It will be appreciated that the present invention process module includes an option, which comprises at least one, and up to four processes for extracting the respective naturally occurring chemical substances in coal if a particular substance or substances are found in the specific coal being used.

It has also been discovered, according to the present invention, that if the process to treat coal to extract substances before the coal is used in a power plant is performed at a facility adjacent to the power plant, then the treated coal is immediately ready for use in the power plant and the costs of transporting the treated coal to be used in the power plant will be significantly reduced. The power plant also can provide the necessary inert gases to safely convey the dry powdered coal through the process steps, and can dispose of any waste gases that may be released by the mercury and oil extraction processes by combustion in the furnace. The integration of the coal-beneficiation process module with the power plant equipment is thereby expected to substantially reduce to the overall cost of the process.

It is therefore an object of the present invention to provide a coal treatment process containing a coal-beneficiation process module. The module is implemented into the conventional coal-fired power plant after the coal treatment process step of grinding the coal to a fine powder. The process module sequentially extracts chemical substances of water, non-combustible ash, mercury and oil that are naturally found in coal before the coal is fired, so that the present invention can achieve objects of increasing efficiency to produce electricity, reducing pollution of environment, and saving the precious natural substances in coal at the coal-fired power plants.

It is another object of the present invention to provide a coal treatment process containing a coal-beneficiation process module, wherein the process module treats the fine coal particles conveyed by an inert sweep gas in a fluidity state to thereby achieve a rapid coal treatment process, provide safe transport of the coal through the process, require less equipment in the coal treatment process, and therefore improves the economic cost of the coal production and treatment.

It is also an object of the present invention to provide two preferred embodiments for extracting the chemical substances, wherein both embodiments have the same first steps of the process module to extract the non-combustible ash and water, which forms a dried powdered coal containing mercury and oil. The first preferred embodiment is comprised of rest of the process to extract chemical substances from within the coal. During the extraction process, microwave energies are irradiated into the coal, which first vaporizes the mercury. The produced mercury vapor that is separated from the coal is then collected to form a liquid mercury product. In the next step of extracting the oil in the coal, the oil is vaporized by irradiation of additional microwave energies, wherein the oil vapor is collected and further condensed to form an oil product.

It is another object of the present invention to provide a second preferred embodiment of the present invention process module, wherein water and a non-combustible ash are first separated from the powdered coal. The second embodiment also includes a step to simultaneously vaporize the mercury and oil in the coal, and then to selectively first condense oil vapor for the oil separation and then condense mercury vapor to thereby collect a liquid mercury product.

It is an additional object of the present invention process module to provide an option to comprise at least one or up to four processes, so that the present invention can extract the respective naturally found chemical substances if a particular substance or substances are within the coal being used.

It is also an object of the present invention to provide a process to treat coal to extract substances before the coal is used in a power plant that is performed at a facility adjacent to the power plant, so that the treated coal is immediately ready for use in the power plant and the costs of transporting the treated coal to be used in the power plant will be significantly reduced. The power plant also can provide the necessary inert gases to safely convey the dry powdered coal through the process steps, and can safely dispose of any waste gases that may be released by the mercury and oil extraction processes by combustion in the furnace.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a coal treatment process containing a coal-beneficiation process module. The module is implemented into the conventional coal-fired power plant after the coal treatment process step of grinding the coal in a coal mill to a fine powder. The process module sequentially extracts chemical substances of water, non-combustible ash, mercury and oil that are naturally found in the coal before the coal is fired, so that present invention can achieve objects of increasing efficiency to produce electricity by burning cleaner coal with low water content, reducing pollution of environment by burning cleaner coal, and obtaining maximum energy from the coal so that less coal is wasted. In addition, by using a hot inert gas derived from the power plant as a sweep gas to convey the material, the process module treats the fine coal particles in a fluidity state to thereby enable the process to be performed safely, rapidly and more efficiently, enabling the process to be performed with less equipment in the coal treatment process and thereby results in a more economical treatment process.

Figure 1:
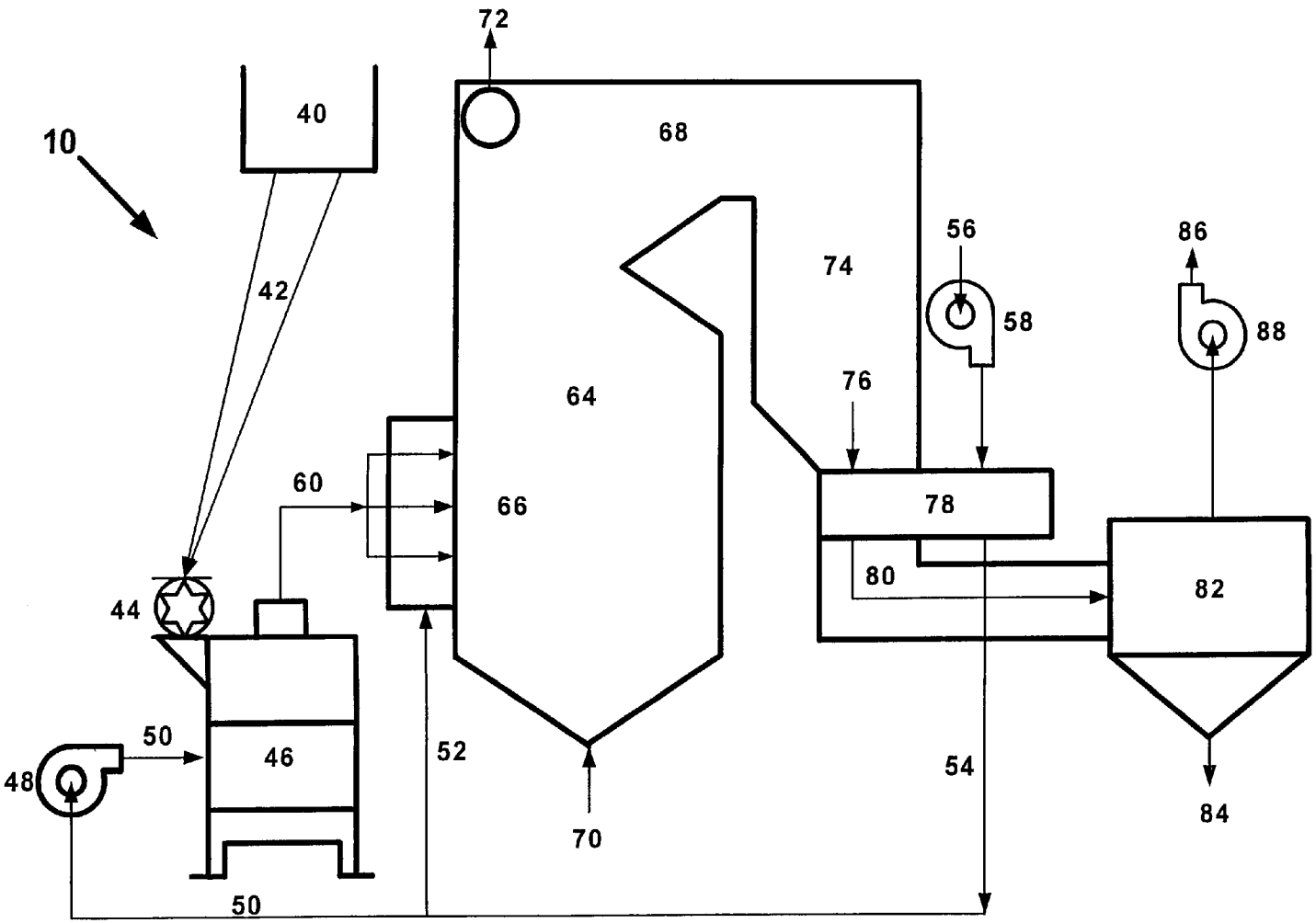
FIG. 1 is a schematic diagram of a traditional process at a typical pulverized coal-fired power plant, which illustrates the primary steps related to coal firing.

Referring to FIG. 1, there is illustrated the conventional process 10 in a typical coal-fired power plant. As illustrated, raw coal 42 is transferred from a coal bunker 40 to a coal feeder 44, which is connected to a coal mill 46. Therefore, the raw coal 42 containing chemical substances of water, non-combustible ash, mercury and oil that are naturally found in the coal, which is fed into the coal mill, is ground into a powdered coal. Preferably, the grinding is achieved so that the ground coal particles have a typical size less than 50 micro meters. During the grinding process, a hot primary air 50 is blown into the mill by a mill fan 48 that is connected to the mill 46. The hot primary air 50 serves to evaporate some moisture from the coal 42 during the grinding process and is cooled. The powdered coal is then mixed with the hot primary air 50 inside of the mill 46 to thereby form a mixture 60 of powdered coal, water vapor and cooled primary air. The mixture 60 of the powdered coal is then swept into burners 66 with the primary air 50. The powdered coal is burned in the presence of the primary air 50 with additional hot secondary air 52 for completion of the coal combustion in the furnace 64.

It will be appreciated that the hot primary air 50 is produced from the ambient combustion air 56 in the above illustrated conventional process. The ambient air 56, which is blown by a fan 58, is heated by a combustion air heater 78, where the exchange of the heat takes place from a hot inert flue gas 76 produced by burning coal in the furnace 64. Therefore, the ambient combustion air 56 is turned into hot combustion air 54, which also serves as the hot primary air 50 and hot secondary air 52 to perform a chemical function in combustion of the powdered coal.

As further illustrated, a boiler feed water 70 is transferred into a boiler 68 that is a built-in apparatus inside of the furnace 64, where heat from the coal firing is exchanged with the water. Therefore, the boiler feed water 70 is converted to boiler steam 72 having a high temperature and pressure. The boiler steam 72, which is out of the boiler 68, is then used as a source of power to drive turbines that are mechanically connected to respective electric generators, so that electricity is produced.

It will be appreciated that the coal combustion produces the hot inert flue gas 76 having less than 10% oxygen and more typically approximately 3% oxygen at an economizer 74 of the furnace 64. The hot inert flue gas 76 passes through the air heater 78, to partially exchange its heat to the ambient combustion air 56, and become a cooler inert flue gas 80. The cooler inert flue gas 80 is then transferred to an emission control unit 82, where waste products 84 are separated and collected. The produced flue gas 86 which is pressurized by a fan 88 is further transferred to a stack for disposal to the atmosphere.

Referring to the above illustrated conventional process at the typical coal fired power plants, it will be appreciated that, the process possesses two major disadvantages. First, it burns and therefore wastes various chemical substances that are naturally found in the coal, including water, non-combustible ash, mercury and oil. Without prior extraction, the water, non-combustible ash, mercury and oil that are in the coal are burned in the coal firing process. By burning these materials in the coal, these materials are wasted. If they are separated from the coal before burning, the materials can be used for other purposes. Further, burning the coal containing these materials reduces the efficiency of the combustion process and results in greater pollution of the air. Another problem encountered in the conventional process is that the hot combustion air that serves as the carrier to transfer the powdered coal in the power plant may provide the condition to cause the coal to burn outside of the furnace in a self-burn process. This can happen because the hot combustion air 54 which has a high temperature and may contain sufficient oxygen (such as 22%) that will support and facilitate the self burning of the coal or cause a dangerous explosion or "puff" event in the equipment. It may be appreciated that the use of an hot inert sweep gas containing less than 10% oxygen and more typically 3% oxygen to transport the powdered coal prevents fires and "puffs" in the equipment.

Figure 2:
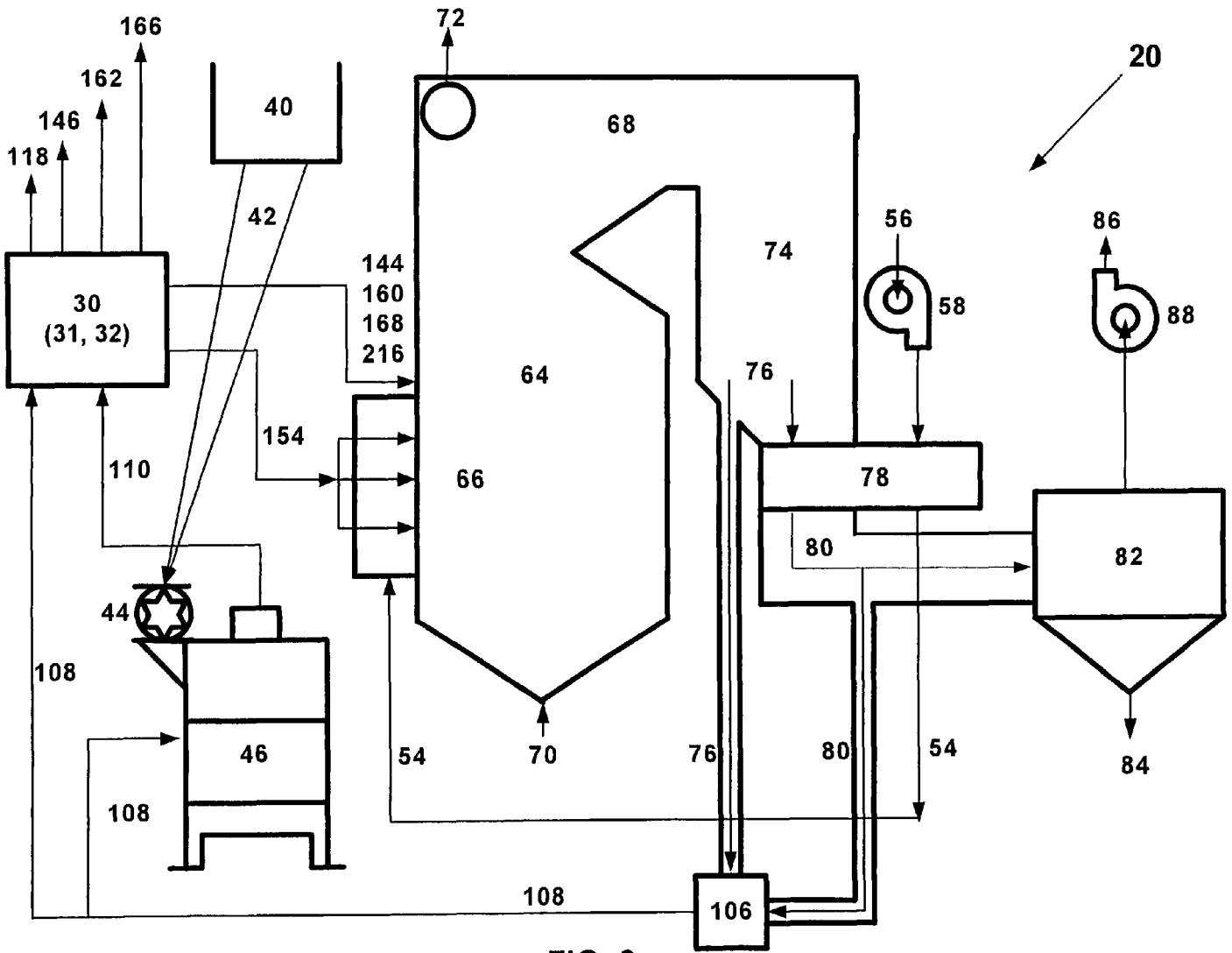
FIG. 2 is a schematic diagram to illustrate that a coal-beneficiation process module is implemented into the traditional process, which forms the present invention.

Referring to FIG. 2, there is illustrated a portion of the improved coal firing process 20 for a coal fired power plant, which implements the present invention coal-beneficiation process module 30 having first and second preferred embodiments 31 and 32. The process module comprises the steps of extracting water, non-combustible ash, mercury and oil before the coal is fired, so that the present invention eliminates these elements from the coal before it is burned in the power plant. As specifically illustrated in FIG. 2, the process module 30 is implemented into the conventional coal-fired power plant after the coal treatment process step of grinding the coal in a coal mill to a fine powder In addition to the implemented process module 30, a sweep gas generator 106 is also added into the present invention. The sweep gas generator 106 generates a sweep gas 108, which includes a low oxygen content at a controllable and adjustable temperature. The addition of the low oxygen sweep gas significantly reduces the risk of the coal self burning which is a problem with the conventional process. As illustrated, a part of the hot inert flue gas 76 is combined with a part of the cool inert flue gas 80 at the sweep gas generator 106 to form the sweep gas 108 having a controlled temperature. It will be appreciated that controlling the temperature of the sweep gas 108 is achieved by controlling the ratio of the hot inert flue gas 76 and cool inert flue gas 80, when they are combined inside of the generator 106. Therefore, the sweep gas 108 having a low oxygen content less than 10% and more typically approximately 3% and controlled temperature prevents the powdered coal from self burning when the coal is transferred by the sweep gas 108 in the process module of the present invention.

As illustrated in FIG. 2, the sweep gas 108 at the controlled temperature is fed into the coal mill 46, along with the raw coal 42, that includes naturally occurring elements including water, non-combustible ash, mercury and oil where it is ground into a powdered coal. During the grinding process, the sweep gas 108 serves to evaporate some moisture from the coal 42 during the grinding process and is cooled. The cool sweep gas, water vapor and powdered coal (containing residual water, mercury, and oil) and non-combustible ash forms a mixture 110. The mixture 110 is conveyed from the mill to the coal-beneficiation process module 30. The mixture 110 is then treated by the present invention process module 30 to thereby obtain a water product 166, oil product 162, mercury product 146 and non-combustible ash 118, in addition to a byproduct of waste sweep gases 144, 160, 168 and 216. The coal-beneficiation process module 30 thereby delivers an improved quality cleaned powdered coal-char product 154 conveyed with additional sweep gas 108 to the coal burners 66. As previously described, the ambient combustion air 56 is turned into hot combustion air 54, which also serves as the hot secondary air 54 to perform a chemical function in combustion of the powdered coal-char product 154 in the furnace 64 thereby generating heat and steam 72.

Figure 3A:
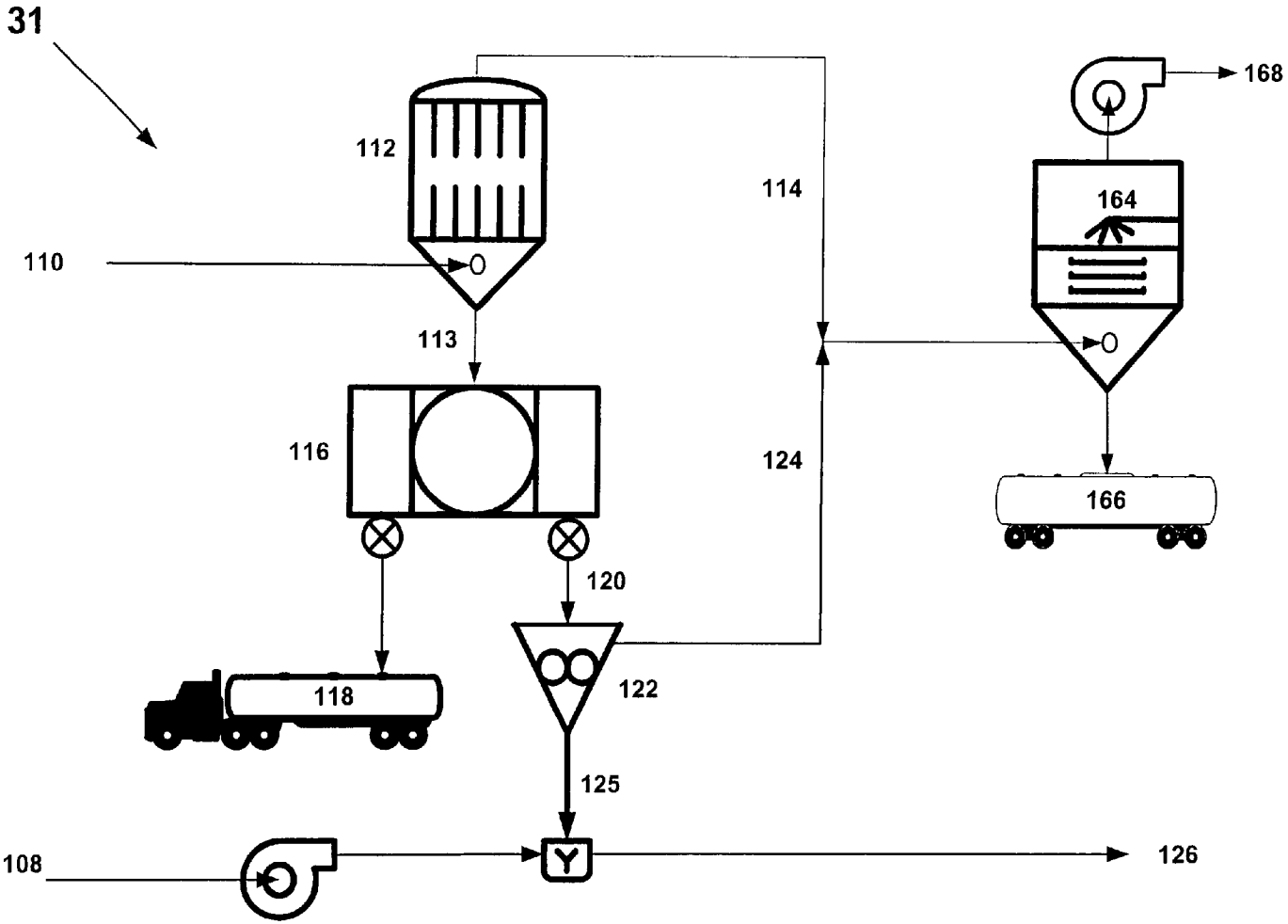
FIG. 3A is a schematic diagram, which illustrate a first part of a first preferred embodiment of the present invention coal-beneficiation process module.
Figure 3B:
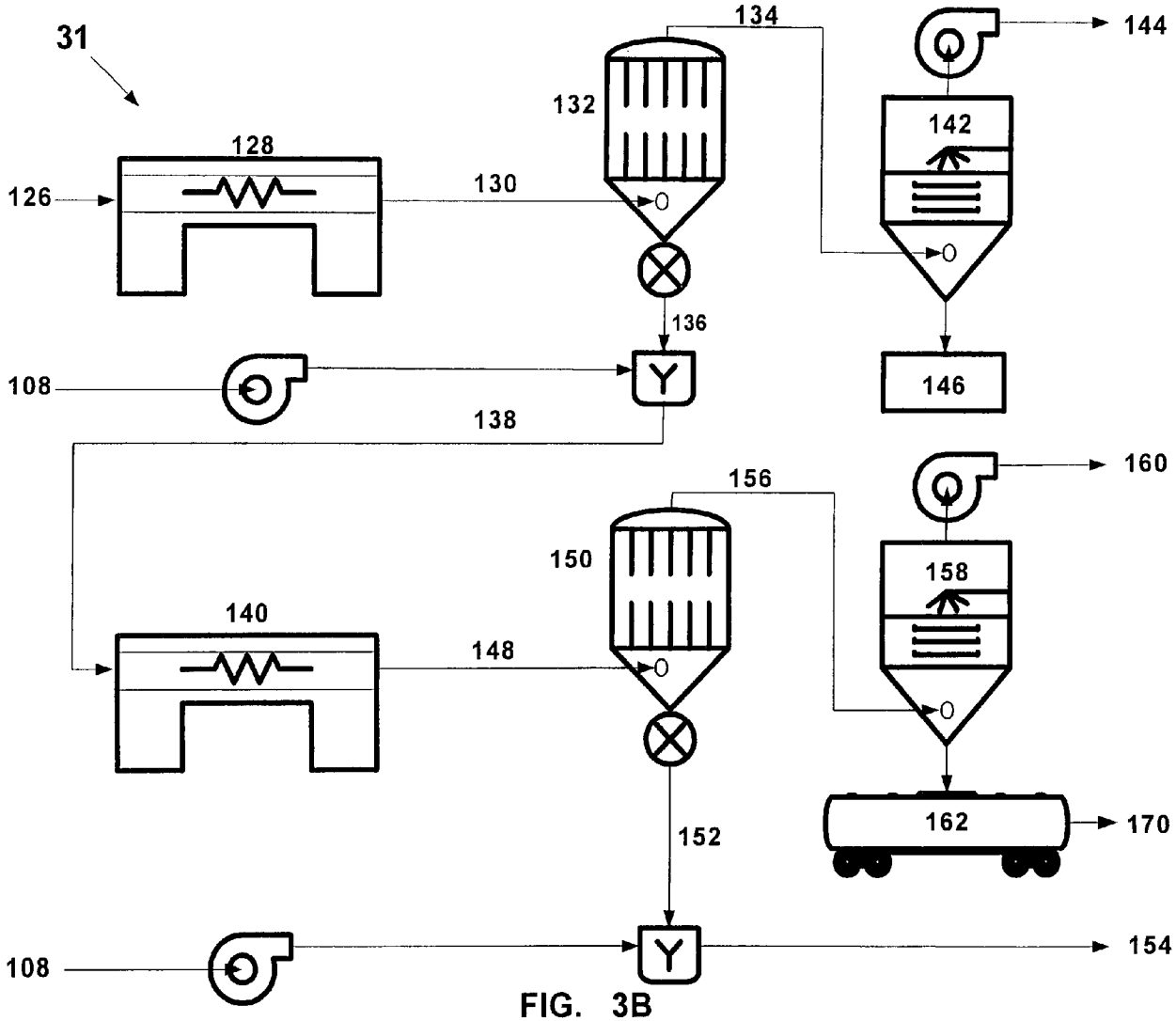
FIG. 3B is a schematic diagram, which illustrates a second part of the first preferred embodiment of the present invention coal-beneficiation process module.

Referring to FIGS. 3A and 3B, there is illustrated first preferred embodiment 31 of the present invention coal-beneficiation process module 30. The mixture 110 of the sweep gas and powdered coal containing water vapor, water, mercury and oil that is mixed with the non-combustible ash is transferred into a conventional bag house separator (or solid-gas separator) 112 for extracting the powdered coal containing, water, mercury and oil that is mixed with the non-combustible ash from the water vapor and sweep gas. It will be appreciated that the separator 112 forms a mixture 114 of a water vapor and the sweep gas at the upper stream of the separator. The mixture 114 is further transferred into a water condenser 164, where clean water 166 is produced and collected at a location downstream of the condenser 164.

As illustrated in FIG. 3A, at a location down stream of the separator 112, a mixture 113 of the powdered non-combustible ash and a less wet powdered coal containing residual water, mercury and oil is produced. The mixture 113 is transferred into a triboelectric separator 116 that is connected to the separator 112.

It will be appreciated that the fine coal powders of the mixture 113 carry no electrical charge from the bag house separation process. The triboelectric separator 116 applies electrical charges to the powder mixture 113. In the present invention, the non-combustible ash 118 is not charged, while the coal powders are electrically charged. In the triboelectric separator 116, an electrostatic field is applied to the powder mixture 113 to produce the separated non-combustible powdered ash 118 that is further collected for disposal, and a mixture 120 of the reduced wetted powdered coal containing residual water, mercury and oil, which is also further collected.

The mixture 120 is transferred into a final coal dryer 122, where any residual water that is associated with the less wetted powdered coal is vaporized in the presence of the sweep gas 108 to form a mixture 124 of the water vapor and sweep gas. It will be appreciated that removing the residual water in the coal in final coal dryer 122 will reduce the time and energy needed to heat the fine dry coal particles with microwave energies in the next process step. As there are a multiple of coal-beneficiation process modules, one for each coal mill, a large quantity of powdered coal can be processed rapidly. The mixture 124 is further transferred to the water condenser 164, where it is combined with the water vapor mixture 114. Therefore, the combined water vapor is converted to water in a liquid form that is further collected to create a total produced water 166 from the present invention process module.

Referring to FIGS. 2 and 3A, the waste sweep gas byproduct 168 with moisture removed is then fed to the furnace 64 for combustion of any contaminated materials derived in the extraction process. In addition, it will be appreciated that removal of the water from the coal, as water vapor in the sweep gas mixture 114 and 124 as provided in the present invention process module, results in an improved combustion efficiency of the furnace 64.

As further illustrated in FIG. 3A, after the final coal drying step, the present invention produces a dried powdered coal 125 containing mercury and oil at a location down stream of the dryer 122. The powdered coal is further mixed by the sweep gas 108 to form a mixture 126. Referring to FIG. 3B, there is illustrated the remaining steps in the first embodiment 31. The mixture 126 is then conveyed by the sweep gas into a first microwave oven 128, where the mixture 126 is heated by the microwave energies to reach a temperature of approximately 400 F. It will be appreciated that the microwave energies will quickly heat the fine dry coal particles sufficiently to vaporize the mercury that is naturally found in the powdered coal. This forms a mixture 130 of a mercury vapor, the sweep gas, and cleaned powdered coal containing oil.

The mixture 130 is transferred into a solid-gas separator 132 for separation. In the separator 132, there is produced a mixture 134 of the mercury vapor and the sweep gas in the upper stream of the separator 132. The mixture 134 is further transferred into a mercury condenser 142 to thereby form a mercury product 146 for safe disposal or further use. In addition, the condensation process further produces a waste sweep gas 144 at the upper stream of the condenser 142.

As illustrated in FIG. 3B, the separation of the mercury vapor mixture 134 further produces a dried cleaned powdered coal 136 containing oil at a location down stream of the separator 132. The coal 136 is then mixed by the sweep gas 108 to form a mixture 138, which is further transferred into a second microwave oven 140 having a preferred temperature approximately at 1000 F, so that the mixture 136 is heated. It will be appreciated that the microwave energies will quickly heat the fine dry coal particles sufficiently to vaporize the oil values associated with the powdered coal 136 to form a mixture 148 of an oil vapor, the sweep gas and a high quality cleaned dried powdered coal-char.

The mixture 148 is transferred into a solid-gas separator 150 where the dried powdered coal-char 152 is produced and collected at a location down stream of the separator 150. Alternatively, in a continuous configuration, the high quality cleaned powdered coal-char 152 is mixed by the sweep gas 108 to form a mixture 154, which can be conveniently transferred.

In addition, a mixture 156 of the oil vapor and sweep gas produced after the separation is transferred into an oil condenser 158. This produces a liquid oil product 162 at a location down stream of the oil condenser, and an additional product waste sweep gas 160 at the upper stream. It will be appreciated that, as illustrated in FIG. 3B, the produced oil product 162 is collected for shipment for use, or for further hydrogenation treatment 170 to form various oil products suitable for conventional refining to transportation fuels, including gasoline, diesel fuel and JP-8 jet fuel.

Referring to FIGS. 2 and 3B, the produced mixture 154 of the high quality cleaned powdered coal-char 152 and sweep gas is transferred to the burners 66 of the furnace 64, where the high quality cleaned powdered coal-char 152 with the sweep gas is burned in the presence of the hot combustion secondary air 54 that is produced according to the step of the conventional process that is illustrated above. Therefore, electricity can be produced following the illustrated procedure as discussed above. It will be appreciated that the combustion of the high quality cleaned powdered coal-char 152 from the present invention wherein the chemicals of water, mercury, and oil have been eliminated to create a more eco-friendly power plant where less pollution is generated than through the conventional process. The present invention burning high quality cleaned powdered coal-char with water removed also results in a much more efficient generation of electricity as compared with the conventional process at the coal-fired power plant. In addition, all the waste sweep gases 144, 160 and 168 that are combined in the process of the present invention are sent into the furnace 64 to burn, wherein the burning of the waste sweep gases efficiently disposes of these gases and results in less environmental pollution.

In a preferred embodiment, the present invention process module 30 and 31 discussed above in FIGS. 2, 3A and 3B is located within or at least adjacent to the power plant illustrated in FIG. 1 so that the high quality cleaned powdered coal-char 152 which is clean coal with the contaminants of water, mercury and oil removed is ready for immediate use in the power plant and it is not necessary to transport the high quality cleaned powdered coal-char from a separate location to the location of the power plant. This significantly reduces costs of transportation and significantly improves the efficiency and safety of the entire electricity generating process.

Figure 4:
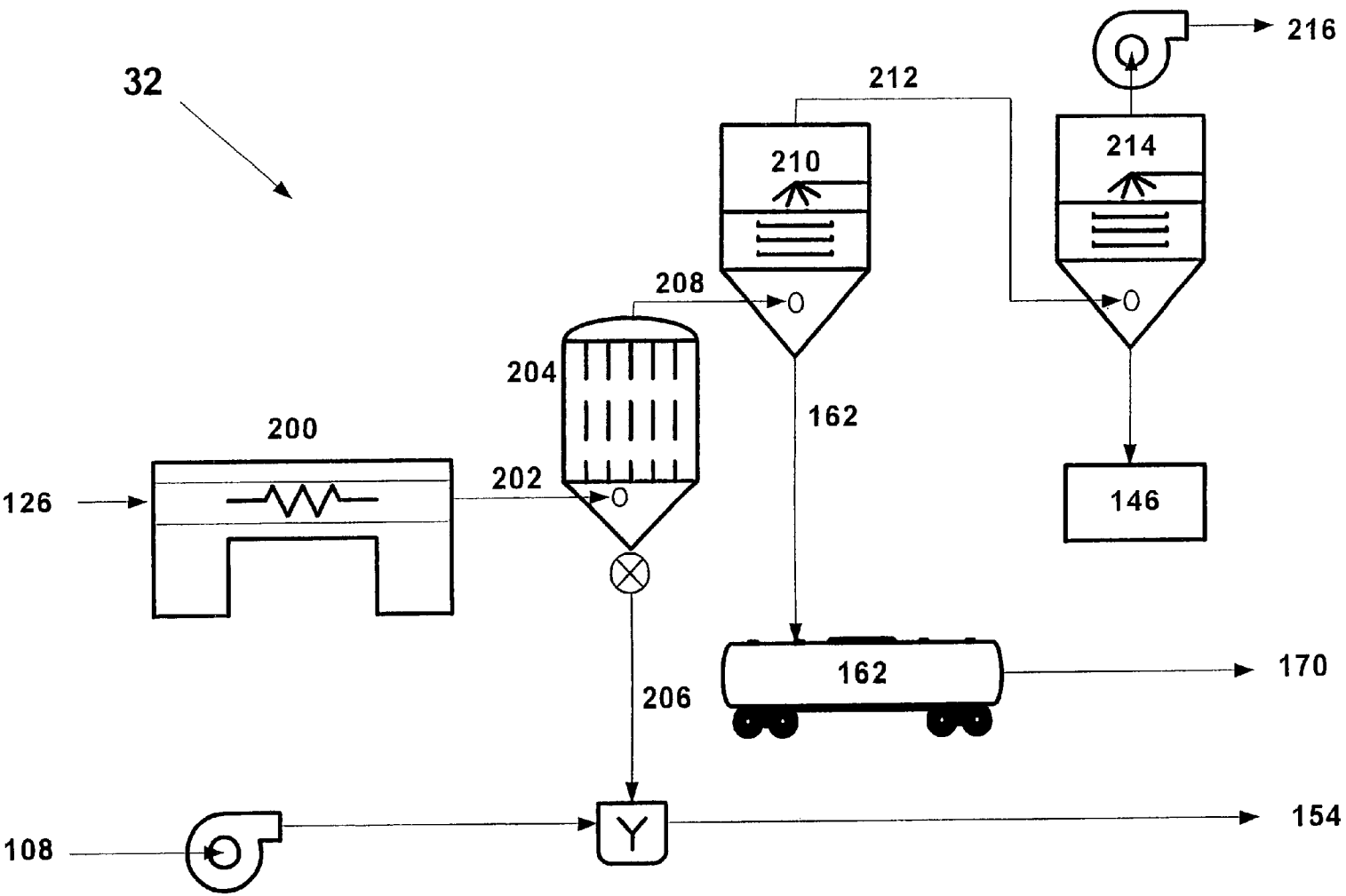
FIG. 4 is a schematic diagram, which illustrates a second part of the second preferred embodiment of the present invention process module, wherein a first part of the preferred embodiment is the same as the first part of the first preferred embodiment of the present invention process module.

It will be appreciated that the present invention also includes a second embodiment 32 of the process module 30, which is illustrated in FIGS. 2 and 4. Referring to FIG. 4 there is illustrated the remaining steps of the second preferred embodiment 32 of the present invention process module 30, which follows first part of the embodiment 30 that extracts water and non-combustible ash. The first part is the same as illustrated in FIG. 3A of the first embodiment 31. Therefore, the first part of the second embodiment 32 will not be repeated and is incorporated herein by reference.

Referring to FIG. 3A, there is illustrated the process to extract the non-combustible ash and water from the coal. As illustrated in FIG. 4, after extracting the water and non-combustible ash, the mixture 126 of the sweep gas and dried powdered coal 125 containing mercury and oil is heated in a microwave oven 200 at a preferred temperature of approximately 1000 F to thereby produce a mixture 202 of the sweep gas, a mercury vapor, an oil vapor and high quality cleaned powdered coal-char. It will be appreciated that the microwave energies will quickly heat the fine dry coal particles sufficiently to vaporize the mercury and oil values associated with the powdered coal 125. The mixture 202 is separated in a bag house separator 204 to produce high quality cleaned powdered coal-char 206 at a location down stream of the separator 204. In the upper stream of the separator 204, there is produced an additional mixture 208 of oil vapor, mercury vapor and sweep gas. The mixture 208 is first transferred to an oil condenser 210, working at a preferred temperature of approximately 500 F where a liquid oil product 162 is produced and then collected. It will be appreciated that, as illustrated in FIG. 4, the produced oil product 162 is collected for shipment for use, or further treated by hydrogenation 170 to form various oil products suitable for refining to transportation fuels, including gasoline, diesel fuel and JP-8 jet fuel.

Referring to FIG. 4, it illustrates that the oil condensation step further produces a mixture 212 of the sweep gas and mercury vapor at the upper stream of the oil condenser 210. The mixture 212 is transferred to a mercury condenser 214 working at a preferred temperature of approximately 300 F. Therefore, it produces a mercury product 146 at a location down stream of the condenser, and a waste sweep gas 216 at the upper stream that is further transferred into the furnace 64 to be safely disposed of by combustion, which is shown in FIG. 2.

In a preferred embodiment, the present invention process module 30 and 32 discussed above in FIGS. 2, 3A and 4 is located within or at least adjacent to the power plant illustrated in FIG. 1 so that the high quality cleaned powdered coal-char 206 which is a cleaned coal with the contaminants of water, mercury and oil removed, is ready for immediate use in the power plant and it is not necessary to transport the high quality cleaned powdered coal-char from a separate location to the location of the power plant. Additionally, locating the process module 30 and 32 adjacent to the power plant allows it to make cost-effective use of the coal mill equipment to powder the coal and to use the furnace exhaust gases associated with the power plant as a source of hot inert sweep gas. This fit to the power plant significantly reduces costs of coal beneficiation and significantly improves the efficiency, safety and economics of the entire electricity generating process.

It will be appreciated that the above disclosed invention process module 30 is targeted for extraction of all four valuables: non-combustible ash, water, mercury and oil that are found in coal. However, if the coal that is being used only contains some of these elements, then the present invention process modules are modified to provide only the steps illustrated to remove the specific one or more elements found in the particular type of coal being used. For example, if only the non-combustible ash and water are contained in a particular coal, the process module only needs to keep steps shown in FIG. 3A. In that setting, the produced cleaned powdered coal 125 can be transferred into the furnace 64 for combustion.

It will be further appreciated that, the present invention process module treats the fine coal particles in a fluidity state when they are mixed by the sweep gas to thereby achieve a rapid coal treatment process, as compared with the conventional methods of treating lumps of coal, which requires significantly larger equipment and extended time to process. Therefore, the present invention provides significant commercial value by requiring less equipment with short coal treatment processing times, which is a significant improvement over these problems found in conventional coal-beneficiation processes.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A coal treatment process applying a coal-beneficiation process module for a coal-fired power plant having a furnace, comprising the steps of:

a. pulverizing raw coal containing water, non-combustible ash, mercury and oil through a coal mill with a first inert sweep gas to form a solid-gaseous mixture that includes a powdered coal containing a residual water, said mercury and oil that is mixed with said non-combustible ash and said first inert sweep gas containing a water vapor at a location of said coal-fired power plant;

b. transferring said solid-gaseous mixture into said coal-beneficiation process module, where said process module comprising the steps of:

i. separating said solid-gaseous mixture in a first solid-gas separator to obtain at a location down stream of the first solid-gas separator said powdered coal containing said residual water, mercury and oil mixed with said non-combustible ash, and said first inert sweep gas containing said water vapor at an upper stream of the first solid-gas separator which is transferred to a water condenser;

ii. separating said powdered coal containing said residual water, mercury and oil further mixed with said non-combustible ash in a triboelectric separator to obtain said non-combustible ash and said powdered coal containing said residual water, mercury and oil;

iii. drying said powdered coal containing said residual water, mercury and oil in a coal dryer to obtain said residual water at an upper stream of the coal dryer and a dried powdered coal containing said mercury and oil at a location down stream of said coal dryer, where said residual water is transferred to a water condenser;

iv. applying a second inert sweep gas to transfer said dried powdered coal containing said oil and mercury into a first microwave oven which applies microwave energies to heat said dried powdered coal containing said mercury and oil to form a first mixture of a mercury vapor, said second inert sweep gas, and a dried powdered coal containing said oil so that said first mixture is transferred into a second solid-gas separator;

v. separating said first mixture to obtain said mercury vapor mixed with said second sweep gas at an upper stream of the second solid-gas separator and said dried powdered coal containing said oil at a down stream of the second solid-gas separator so that said mercury vapor mixed with said second sweep gas is transferred into a mercury condenser where a liquid mercury product is formed and collected, and said dried powdered coal containing said oil mixed with a third inert sweep gas is transferred into a second microwave oven;

vi. applying microwave energies to heat said dried powdered coal containing said oil mixed with said third inert sweep gas to obtain a second mixture of an oil vapor, said third inert sweep gas and a cleaned powdered coal-char where said second mixture is transferred into a third solid-gas separator, said cleaned powdered coal-char is obtained at a location down stream of the third solid-gas separator, and said oil vapor mixed with said third inert sweep gas is obtained at an upper stream of the third solid-gas separator and which is further transferred into an oil condenser;

vii. condensing said oil vapor mixed with said third sweep gas oil to form a liquid oil product at a location down stream of the oil condenser; and viii. applying a fourth inert sweep gas to transfer said cleaned powdered coal-char into burners of said furnace;

c. burning said cleaned powdered coal-char inside of said furnace in the presence of a hot combustion air, wherein said coal-char burning generates heat, controllable pollutant emission, and a hot inert flue gas in said furnace, and said generated heat is used to heat water in a process to produce electricity; and d. said hot inert flue gas is divided into first and second streams, said first stream of said hot inert flue gas is transferred to an external sweep gas generator, said second stream of said hot inert flue gas is transferred to a heat exchanger of said furnace thereby creating a cold inert flue gas that is further transferred to said external sweep gas generator, said hot inert flue gas and said cold inert flue gas are mixed inside of said external sweep gas generator wherein a ratio of mixing said hot and cold inert flue gases is controlled to generate said first, second, third and fourth inert sweep gases being identical and having a controllable temperature that are applied in said coal-beneficiation process module.

2. A coal treatment process applying a coal-beneficiation process module for a coal-fired power plant having a furnace, comprising the steps of:

a. pulverizing raw coal containing at least water and non-combustible ash through a coal mill with a first inert sweep gas to form a solid-gaseous mixture that includes a powdered coal containing a residual water that is mixed with said non-combustible ash and said first inert sweep gas containing a water vapor at a location of said coal-fired power plant;

b. transferring said solid-gaseous mixture into said coal-beneficiation process module, where said process module comprising the steps of:

i. separating said mixture in a solid-gas separator to obtain at a location down stream of the solid-gas separator said powdered coal containing said residual water mixed with said non-combustible ash, and said first inert sweep gas containing said water vapor at an upper stream of the solid-gas separator so that said first inert sweep gas containing said water vapor is transferred to a water condenser;

ii. separating said powdered coal containing said residual water mixed with said non-combustible ash in a triboelectric separator to obtain said non-combustible ash and said powdered coal containing said residual water; and iii. applying a second inert sweep gas to transfer said powdered coal containing said residual water into said furnace;

c. burning said powdered coal containing said residual water inside of said furnace in the presence of a hot combustion air, wherein said powdered coal burning generates heat, controllable pollutant emissions, and a hot inert flue gas in said furnace, and said generated heat is used to heat water in a process to produce electricity; and d. said hot inert flue gas is divided into first and second streams, said first stream of said hot inert flue gas is transferred to an external sweep gas generator, said second stream of said hot inert flue gas is transferred to a heat exchanger of said furnace thereby creating a cold inert flue gas that is further transferred to said external sweep gas generator, said hot inert flue gas and said cold inert flue gas are mixed inside of said external sweep gas generator wherein a ratio of mixing said hot and cold inert flue gases is controlled to generate said first and second inert sweep gas being identical and having a controllable temperature that is applied in said coal-beneficiation process module.

3. A coal treatment process applying a coal-beneficiation process module for a coal-fired power plant having a furnace, comprising the steps of:

a. pulverizing raw coal containing water, non-combustible ash, and an oil through a coal mill with a first inert sweep gas to form a solid-gaseous mixture that includes a powdered coal containing a residual water and said oil that is mixed with said non-combustible ash and said first inert sweep gas containing a water vapor at a location of said coal-fired power plant;

b. transferring said solid-gaseous mixture into said coal-beneficiation process module, where said process module comprising the steps of:

i. separating said solid-gaseous mixture in a first solid-gas separator to obtain at a location down stream of the first solid-gas separator said powdered coal containing said residual water and oil mixed with said non-combustible ash, and said first inert sweep gas containing said water vapor at an upper stream of the first solid-gas separator so that said first inert sweep gas containing said water vapor is transferred to a water condenser;

ii. separating said powdered coal containing said residual water and oil mixed with said non-combustible ash in a triboelectric separator to obtain said non-combustible ash and a said powdered coal containing said residual water and oil;

iii. drying said powdered coal containing said residual water and oil in a coal dryer to obtain said residual water at an upper stream of the coal dryer and a dried powdered coal containing said oil at a location down stream of said coal dryer;

iv. applying a second inert sweep gas to transfer said dried powdered coal containing said oil into a microwave oven which applies microwave energies to heat said dried powdered coal containing said oil to obtain a mixture of an oil vapor mixed with said second inert sweep gas and a cleaned dried powdered coal-char, said mixture is transferred into a second solid-gas separator, wherein said cleaned dried powdered coal-char is obtained at a location down stream of the oil second solid-gas separator, and said oil vapor mixed with said second inert sweep gas is obtained at an upper stream of the second solid-gas separator and is further transferred into an oil condenser;

v. condensing said oil vapor mixed with said second inert sweep gas oil to form a liquid oil product at a location down stream of the oil condenser; and vi applying a third inert sweep gas to transfer said cleaned powdered coal-char into burners of said furnace;

c. burning said cleaned dried powdered coal-char inside of said furnace in the presence of a hot combustion air, wherein said coal-char burning generates heat, controllable pollutant emissions, and a hot inert flue gas in said furnace, and said generated heat is used to heat water in a process to produce electricity; and d. said hot inert flue gas is divided into first and second streams, said first stream of said hot inert flue gas is transferred to an external sweep gas generator, said second stream of said hot inert flue gas is transferred to a heat exchanger of said furnace thereby creating a cold inert flue gas that is further transferred to said external sweep gas generator, said hot inert flue gas and said cold inert flue gas are mixed inside of said external sweep gas generator wherein a ratio of mixing said hot and cold inert flue gases is controlled to generate said first, second and third inert sweep gases having a controllable temperature that are applied in said coal-beneficiation process module.

4. A coal treatment process in accordance with claim 3 where said first, second and third inert sweep gases are identical.

5. A coal treatment process applying a coal-beneficiation process module for a coal-fired power plant having a furnace, comprising the steps of:

a. pulverizing raw coal containing water, non-combustible ash and mercury through a coal mill with a first inert sweep gas to form a solid-gaseous mixture that includes a powdered coal containing a residual water and mercury that is mixed with said non-combustible ash and said first inert sweep gas containing water vapor at a location of said coal-fired power plant;

b. transferring said solid-gaseous mixture into said coal-beneficiation process module, where said process module comprising the steps of:

i. separating said solid-gaseous mixture in a first solid-gas separator to obtain at a location down stream of the first solid-gas separator said powdered coal containing said residual water and mercury mixed with said non-combustible ash, and said first inert sweep gas containing said water vapor at an upper stream of the first solid-gas separator so that said first inert sweep gas containing said water vapor is transferred to a water condenser;

ii. separating said powdered coal containing said residual water and mercury mixed with said non-combustible ash in a triboelectric separator to obtain said non-combustible ash and said powdered coal containing said residual water and mercury;

iii. drying said powdered coal containing said residual water and mercury in a coal dryer to obtain said residual water at an upper stream of the coal dryer and a dried powdered coal containing said mercury at a location down stream of said coal dryer;

iv. applying a second inert sweep gas to transfer said dried powdered coal containing said mercury into a microwave oven which applies microwave energies to heat said dried powdered coal containing said mercury to form a mixture of a mercury vapor mixed with said second inert sweep gas and a cleaned dried powdered coal-char so that said mixture is transferred into a second solid-gas separator; and v. separating said mixture to obtain said mercury vapor mixed with said second inert sweep gas at an upper stream of the second solid-gas separator and said cleaned dried powdered coal-char at a down stream of the second solid-gas separator and said mercury vapor mixed with said second inert sweep gas is transferred into a mercury condenser where a liquid mercury product is formed and collected; and vi applying a third inert sweep gas to transfer said cleaned dried powdered coal-char into burners of said furnace;

c. burning said cleaned dried powdered coal-char inside of said furnace in the presence of a hot combustion air, wherein said coal-char burning generates heat, controllable pollutant emissions, and a hot inert flue gas in said furnace, and said generated heat is used to heat water in a process to produce and electricity; and d. said hot inert flue gas is divided into first and second streams, said first stream of said hot inert flue gas is transferred to an external sweep gas generator, said second stream of said hot inert flue gas is transferred to a heat exchanger of said furnace thereby creating a cold inert flue gas that is further transferred to said external sweep gas generator, said hot inert flue gas and said cold inert flue gas are mixed inside of said external sweep gas generator wherein a ratio of mixing said hot and cold inert flue gases is controlled to generate said first, second and third inert sweep gases having a controllable temperature that are applied in said coal-beneficiation process module.

6. A process in accordance with claim 5 further comprising said first, second and third inert sweep gases are identical.

7. A coal treatment process applying a coal-beneficiation process module for a coal-fired power plant having a furnace, comprising the steps of:

a. pulverizing raw coal containing water, non-combustible ash, mercury and oil through a coal mill with a first inert sweep gas to form a solid-gaseous mixture that includes a powdered coal containing a residual water, mercury and oil that is mixed with non-combustible ash and said first inert sweep gas containing a water vapor at a location of said coal-fired power plant;

b. transferring said solid-gaseous mixture into said coal-beneficiation process module, where said process module comprising the steps of:

i. separating said solid-gaseous mixture in a first solid-gas separator to obtain at a location down stream of the first solid-gas separator said powdered coal containing said residual water, mercury and oil mixed with said non-combustible ash, and said first inert sweep gas containing said water vapor at an upper stream of the first solid-gas separator so that said first inert sweep gas containing said water vapor is transferred to a water condenser;

ii. separating said powdered coal containing said residual water, mercury and oil mixed with said non-combustible ash in a triboelectric separator to obtain said non-combustible ash and said powdered coal containing said residual water, mercury and oil;

iii. drying said powdered coal containing said residual water, mercury and oil in a coal dryer to obtain said residual water at an upper stream of the coal dryer and a dried powdered coal containing said oil and mercury at a location down stream of said coal dryer;

iv. applying a second inert sweep gas to transfer said dried powdered coal containing said mercury and oil into a microwave oven which applies microwave energies to heat said dried powdered coal containing said mercury and oil to form a mixture of a mercury vapor and oil vapor mixed with said second inert sweep gas, and a cleaned powdered coal-char so that said mixture is transferred into a second solid-gas separator;

v. separating said mixture to obtain said mercury vapor and said oil vapor mixed with said second inert sweep gas at an upper stream of the second solid-gas separator, and said cleaned powdered coal-char at a down stream location of the second solid-gas separator, said mercury vapor and oil vapor mixed with said second inert sweep are transferred into an oil condenser, where a liquid oil product is formed and collected at a location down stream of the oil condenser, and said mercury vapor mixed with said second inert sweep gas is obtained at an upper stream of the oil condenser, which is further transferred to a mercury separator;

vi. condensing said mercury vapor mixed with second inert sweep gas in a said mercury condenser to obtain a liquid mercury product at a location down stream of the mercury condenser; and vii. Applying a third inert sweep gas to transfer said cleaned powdered coal-char into burners of said furnace;

c. burning said cleaned powdered coal-char inside of said furnace in the presence of a hot combustion air, wherein said coal-char burning generates heat, controllable pollutant emissions, and a hot inert flue gas in said furnace, and said generated heat is used to heat water in a process to produce electricity; and d. said hot inert flue gas is divided into first and second streams, said first stream of said hot inert flue gas is transferred to an external sweep gas generator, said second stream of said hot inert flue gas is transferred to a heat exchanger of said furnace thereby creating a cold inert flue gas that is further transferred to said external sweep gas generator, said hot inert flue gas and said cold inert flue gas are mixed inside of said external sweep gas generator wherein a ratio of mixing said hot and cold inert flue gases is controlled to generate said first, second and third inert sweep gases having a controllable temperature that are applied in said coal-beneficiation process module.

8. The process in accordance with claim 7 further comprising, said first, second and third sweep gases are identical.

9. A coal-liquid-extraction process module, wherein said process module enables recovery of a non-combustible ash, water, mercury and oil that are found in coal in a powdered form, comprising the steps of:

a. at a location of a power plant having a furnace, separating said powdered coal associated with said non-combustible ash, water, mercury and oil further mixed with a an inert sweep gas in a first solid-gas separator to obtain at a location down stream of the first solid-gas separator a powdered coal containing a residual water, mercury and oil mixed with said non-combustible ash, and said inert sweep gas containing a water vapor at an upper stream of the first solid-gas separator which is transferred to a water condenser;

b. separating said powdered coal containing said residual water, mercury and oil that is mixed with said non-combustible ash in a triboelectric separator to obtain said non-combustible ash and said powdered coal containing said residual water, mercury and oil;

c. drying said powdered coal containing said residual water, mercury and oil in a coal dryer to obtain said residual water at an upper stream of the coal dryer and a dried powdered coal containing said oil and mercury at a location down stream of said coal dryer;

d. applying microwave energies to heat said dried powdered coal containing said oil and mercury in a first microwave oven to form a first mixture of a mercury vapor, and a dried powdered coal containing said oil, wherein said first mixture is transferred into a second solid-gas separator;

e. separating said first mixture to obtain said mercury vapor at an upper stream of the second solid-gas separator and said dried powdered coal containing said oil at a location down stream of the second solid-gas separator, said mercury vapor is transferred into a mercury condenser where a liquid mercury product is formed and collected, and said dried powdered coal containing said oil is transferred into a second microwave oven;

applying microwave energies to heat said dried powdered coal containing said oil to obtain a second mixture of an oil vapor and a cleaned powdered coal-char wherein said second mixture is transferred into a third solid-gas separator, said cleaned powdered coal-char is obtained at a location down stream of the third solid-gas separator and which is transferred into burners of said furnace wherein said coal-char burning generates heat, controllable pollutant emissions, and a hot inert flue gas in said furnace, and said oil vapor is obtained at an upper stream of the third solid-gas separator and which is further transferred into an oil condenser;

g. condensing said oil vapor to form a liquid oil product at a location down stream of the oil condenser; and h. said hot inert flue gas is divided into first and second streams, said first stream of said hot inert flue gas is transferred to an external sweep gas generator, said second stream of said hot inert flue gas is transferred to a heat exchanger of said furnace thereby creating a cold inert flue gas that is further transferred to said external sweep gas generator, said hot inert flue gas and said cold inert flue gas are mixed inside of said external sweep gas generator wherein a ratio of mixing said hot and cold inert flue gases is controlled to generate said inert sweep gases having a controllable temperature that is applied in said coal-liquid-extraction process module.

10. A coal-liquid-extraction process module, wherein said process module enables recovery of a non-combustible ash and water that are found in coal in a powdered form, comprising the steps of:

a. at a location of a power plant having a furnace, separating said powdered coal associated with said non-combustible ash and water further mixed with an inert sweep gas in a solid-gas separator to obtain at a location down stream of the solid-gas separator a powdered coal containing a residual water mixed with said non-combustible ash, and a said inert sweep gas containing a water vapor at an upper stream of the solid-gas separator, which is transferred to a water condenser;

b. separating said powdered coal containing said residual water that is mixed with said non-combustible ash in a triboelectric separator to obtain said non-combustible ash and said powdered coal containing said residual water;

c. drying said powdered coal containing said residual water in a coal dryer to obtain said residual water at an upper stream of the coal dryer and a dried powdered coal-char at a location down stream of said coal dryer, which is transferred into burners of said furnace wherein said coal-char burning generates heat, controllable pollutant emissions, and a hot inert flue gas in said furnace; and d. said hot inert flue gas is divided into first and second streams, said first stream of said hot inert flue gas is transferred to an external sweep gas generator, said second stream of said hot inert flue gas is transferred to a heat exchanger of said furnace thereby creating a cold inert flue gas that is further transferred to said external sweep gas generator, said hot inert flue gas and said cold inert flue gas are mixed inside of said external sweep gas generator wherein a ratio of mixing said hot and cold inert flue gases is controlled to generate said inert sweep gases having a controllable temperature that is applied in said coal-liquid-extraction process module.

11. A coal-liquid-extraction process module, wherein said process module enables recovery of a non-combustible ash, water and oil that are found in coal in a powdered form, comprising the steps of a. at a location of a power plant having a furnace, separating said powdered coal associated with said non-combustible ash, water, and oil further mixed with a an inert sweep gas in a solid-gas separator to obtain at a location down stream of the solid-gas separator a powdered coal containing a residual water and oil mixed with said non-combustible ash, and said inert sweep gas containing a water vapor at an upper stream of the solid-gas separator, wherein said inert sweep gas containing said water vapor is transferred to a water condenser;

b. separating said powdered coal containing said residual water and oil that is mixed with said non-combustible ash in a triboelectric separator to obtain said non-combustible ash and said powdered coal containing said residual water and oil;

c. drying said powdered coal containing said residual water and oil in a coal dryer to obtain said residual water at an upper stream of the coal dryer and a dried powdered coal containing said oil at a location down stream of said coal dryer;

d. applying microwave energies to heat said dried powdered coal containing said oil to obtain an oil vapor, and a cleaned dried powdered coal-char which is transferred into burners of said furnace wherein said coal-char burning generates heat, controllable pollutant emissions, and a hot inert flue gas in said furnace, and said oil vapor is further transferred into an oil condenser;

e. condensing said oil vapor to form a liquid oil product at a location down stream of the oil condenser; and f. said hot inert flue gas is divided into first and second streams, said first stream of said hot inert flue gas is transferred to an external sweep gas generator, said second stream of said hot inert flue gas is transferred to a heat exchanger of said furnace thereby creating a cold inert flue gas that is further transferred to said external sweep gas generator, said hot inert flue gas and said cold inert flue gas are mixed inside of said external sweep gas generator wherein a ratio of mixing said hot and cold inert flue gases is controlled to generate said inert sweep gases having a controllable temperature that is applied in said coal-liquid-extraction process module.

12. A coal-liquid-extraction process module, wherein said process module enables recovery of a non-combustible ash, water and mercury that are found in coal in a powdered form, comprising the steps of:

a. at a location of a power plant having a furnace, separating said powdered coal associated with said non-combustible ash, water and mercury further mixed with an inert sweep gas in a first solid-gas separator to obtain at a location down stream of the first solid-gas separator said powdered coal containing said residual water and mercury mixed with said non-combustible ash, and said inert sweep gas containing a water vapor at an upper stream of the first solid-gas separator, wherein said inert sweep gas containing said water vapor is transferred to a water condenser;

b. separating said powdered coal containing said residual water and mercury that is mixed with said non-combustible ash in a triboelectric separator to obtain said non-combustible ash and said powdered coal containing said residual water and mercury;

c. drying said powdered coal containing said residual water and mercury in a coal dryer to obtain said residual water at an upper stream of the coal dryer and a dried powdered coal containing said mercury at a location down stream of said coal dryer;

d. applying microwave energies to heat said dried powdered coal containing said mercury in a microwave oven to form a mixture of a mercury vapor and a cleaned dried powdered coal-char, wherein said mixture is transferred into a second solid-gas separator;

e. separating said mixture to obtain said mercury vapor at an upper stream of the second solid-gas separator and said cleaned dried powdered coal-char at a location down stream of the second solid-gas separator which is transferred into burners of said furnace wherein said coal-char burning generates heat, controllable pollutant emissions, and a hot inert flue gas in said furnace, said mercury vapor is transferred into a mercury condenser where a liquid mercury product is formed and collected; and f. said hot inert flue gas is divided into first and second streams, said first stream of said hot inert flue gas is transferred to an external sweep gas generator, said second stream of said hot inert flue gas is transferred to a heat exchanger of said furnace thereby creating a cold inert flue gas that is further transferred to said external sweep gas generator, said hot inert flue gas and said cold inert flue gas are mixed inside of said external sweep gas generator wherein a ratio of mixing said hot and cold inert flue gases is controlled to generate said first and second inert sweep gases being identical and having a controllable temperature that are applied in said coal-liquid-extraction process module.

13. A coal-liquid-extraction process module, wherein said process module enables the recovery of a non-combustible ash, water, mercury and oil that are found in coal in a powdered form, comprising the steps of:

a. at a location of a power plant having a furnace, separating a mixture of an inert sweep gas containing a water vapor and a powdered coal containing a residual water, mercury and oil that is mixed with said non-combustible ash in a first solid-gas separator to obtain at a location down stream of the first solid-gas separator said powdered coal containing said residual water, oil and mercury that is mixed with said non-combustible ash, and said inert sweep gas containing said water vapor at an upper stream of the first solid-gas separator, wherein said inert sweep gas containing said water vapor is transferred to a water condenser;

b. separating said powdered coal containing said residual water, mercury and oil that is mixed with said non-combustible ash in a triboelectric separator to obtain said non-combustible ash and said powdered coal containing said residual water, mercury and oil;

c. drying said powdered coal containing said residual water, mercury and oil in a coal dryer to obtain said residual water at an upper stream of the dryer and a dried powdered coal containing said mercury and oil at a down stream of said dryer;

d. applying microwave energies to heat said dried powdered coal containing said mercury and oil in a microwave oven to form a mixture of a mercury vapor, an oil vapor, and a cleaned powdered coal-char, wherein said mixture is transferred into a second solid-gas separator;

e. separating said mixture to obtain said mercury vapor and said oil vapor at an upper stream of the second solid-gas separator, and said cleaned powdered coal-char at a down stream of the second solid-gas separator that is further transferred into burners of said furnace wherein said coal-char burning generates heat, controllable pollutant emissions, and a hot inert flue gas in said furnace, said mercury vapor and oil vapor are transferred into an oil condenser, where a liquid oil product is formed and collected at a location down stream of the oil condenser, and said mercury vapor is obtained at an upper stream of the oil condenser which is further transferred to a mercury condenser;

f. condensing said mercury vapor in said mercury condenser to obtain a liquid mercury product at a down stream of the mercury condenser; and g. said hot inert flue gas is divided into first and second streams, said first stream of said hot inert flue gas is transferred to an external sweep gas generator, said second stream of said hot inert flue gas is transferred to a heat exchanger of said furnace thereby creating a cold inert flue gas that is further transferred to said external sweep gas generator, said hot inert flue gas and said cold inert flue gas are mixed inside of said external sweep gas generator wherein a ratio of mixing said hot and cold inert flue gases is controlled to generate said inert sweep gases having a controllable temperature that is applied in said coal-liquid-extraction process module.

* * * * *